US010485384B2

(12) United States Patent
Kurchev et al.

(10) Patent No.: US 10,485,384 B2
(45) Date of Patent: Nov. 26, 2019

(54) DISPENSER WITH NOZZLE APERTURE GUARD

(71) Applicant: GOJO Industries, Inc., Akron, OH (US)

(72) Inventors: Aaron Michael Kurchev, Atwater, OH (US); Michael Prediger, Rittman, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/443,396

(22) Filed: Feb. 27, 2017

(65) Prior Publication Data

US 2017/0245697 A1 Aug. 31, 2017

Related U.S. Application Data

(60) Provisional application No. 62/300,137, filed on Feb. 26, 2016.

(51) Int. Cl.
*A47K 5/12* (2006.01)

(52) U.S. Cl.
CPC ..... *A47K 5/1211* (2013.01); *A47K 5/1217* (2013.01)

(58) Field of Classification Search
CPC .... A47K 5/1211; A47K 5/1217; B65D 25/38; B65D 43/16; B65D 55/14
See application file for complete search history.

(56) References Cited

U.S. PATENT DOCUMENTS 4,667,854 A * 5/1987 McDermott ..... A47K 5/1215 222/101
4,741,461 A * 5/1988 Williamson ..... A47K 5/1209 16/227
5,638,989 A * 6/1997 Ophardt ..... A47K 5/1207 222/105
6,209,751 B1 * 4/2001 Goodin ..... A47K 5/1211 222/52
6,607,103 B2 * 8/2003 Gerenraich ..... A47K 5/1217 222/183
7,048,152 B2 * 5/2006 Bunoz ..... A47K 5/1202 222/182
7,086,567 B1 * 8/2006 Ciavarella ..... A47K 5/1202 222/105
7,278,554 B2 * 10/2007 Armstrong ..... A47K 5/1202 222/181.1
8,336,740 B1 * 12/2012 Daansen ..... A47K 5/1207 222/181.3
8,387,832 B2 * 3/2013 Zlatic ..... A47K 5/122 222/181.3

(Continued)

*Primary Examiner* — David P Angwin
*Assistant Examiner* — Bob Zadeh
(74) *Attorney, Agent, or Firm* — Cooper Legal Group, LLC

(57) ABSTRACT

A product dispenser includes an enclosure having at least one wall that defines an interior of the enclosure. The wall defines an aperture. The product dispenser includes a dispensing assembly within which a product is contained and from which the product is dispensed. The dispensing assembly is supported within the interior of the enclosure such that the dispensing assembly dispenses the product through the aperture. The product dispenser includes a barrier guard extending around a perimeter of the aperture between the wall and the dispensing assembly to inhibit accessibility to the interior of the enclosure between the barrier guard and the wall.

20 Claims, 14 Drawing Sheets

(56) References Cited

U.S. PATENT DOCUMENTS

| | | | | |
|---|---|---|---|---|
| 8,558,701 | B2 * | 10/2013 | Wegelin | A47K 5/1217 340/573.1 |
| 8,851,331 | B2 * | 10/2014 | Pelkey | A47K 5/1202 222/181.3 |
| 9,561,517 | B2 * | 2/2017 | Wertheim | B05B 11/0037 |
| 2009/0120950 | A1 * | 5/2009 | Titas | A47K 10/3818 221/45 |
| 2010/0224651 | A1 * | 9/2010 | Zlatic | A47K 5/122 222/182 |
| 2014/0203045 | A1 * | 7/2014 | Mann | A47K 5/1211 222/181.3 |
| 2016/0309967 | A1 * | 10/2016 | Pelfrey | A47K 5/1217 |
| 2017/0245697 | A1 * | 8/2017 | Kurchev | A47K 5/1211 |

* cited by examiner

DISPENSER WITH NOZZLE APERTURE GUARD

CROSS-REFERENCE TO RELATED APPLICATIONS

This application claims priority to U.S. Provisional Patent Application No. 62/300,137, filed on Feb. 26, 2016, the entire disclosure of which is hereby incorporated by reference.

TECHNICAL FIELD

The instant application is generally directed towards a product dispenser. For example, the instant application is directed towards a barrier guard for a product dispenser.

BACKGROUND

Dispensing systems can dispense a sanitizing material to a user. Dispensing systems can be used, for example, in schools, hospitals, nursing homes, factories, restaurants, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a product dispenser comprises an enclosure having at least one wall that defines an interior of the enclosure. The wall defines an aperture. The product dispenser comprises a dispensing assembly within which a product is contained and from which the product is dispensed. The dispensing assembly is supported within the interior of the enclosure such that the dispensing assembly is configured to dispense the product through the aperture. The product dispenser comprises a barrier guard extending around a perimeter of the aperture between the wall and the dispensing assembly to inhibit accessibility to the interior of the enclosure between the barrier guard and the wall.

In an example, a product dispenser comprises an enclosure comprising a base portion configured to be attached to a surface. The enclosure comprises a cover portion attached to the base portion. The cover portion and the base portion define an interior of the enclosure. At least one of the cover portion or the base portion defines an aperture. The product dispenser comprises a dispensing assembly within which a product is contained and from which the product is dispensed. The dispensing assembly is supported within the interior of the enclosure. The dispensing assembly comprises a product pump configured to dispense the product and a nozzle in fluid communication with the product pump. The product is dispensed by the product pump through the nozzle and through the aperture. A barrier guard extends around a perimeter of the aperture between the nozzle of the dispensing assembly and at least one of the cover portion or the base portion to inhibit accessibility to the interior of the enclosure between the barrier guard and the enclosure In an example, a product dispenser comprises an enclosure having at least one wall that defines an interior of the enclosure. The wall defines an aperture. The product dispenser comprises a dispensing assembly within which a product is contained and from which the product is dispensed. The dispensing assembly is supported within the interior of the enclosure such that the dispensing assembly is configured to dispense the product through the aperture. The product dispenser comprises a barrier guard having a first end and a second end. The first end of the barrier guard is attached to an interior surface of the wall and extends around a perimeter of the aperture. The second end of the barrier guard is in proximity to the dispensing assembly to inhibit accessibility to the interior of the enclosure between the barrier guard and the wall.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
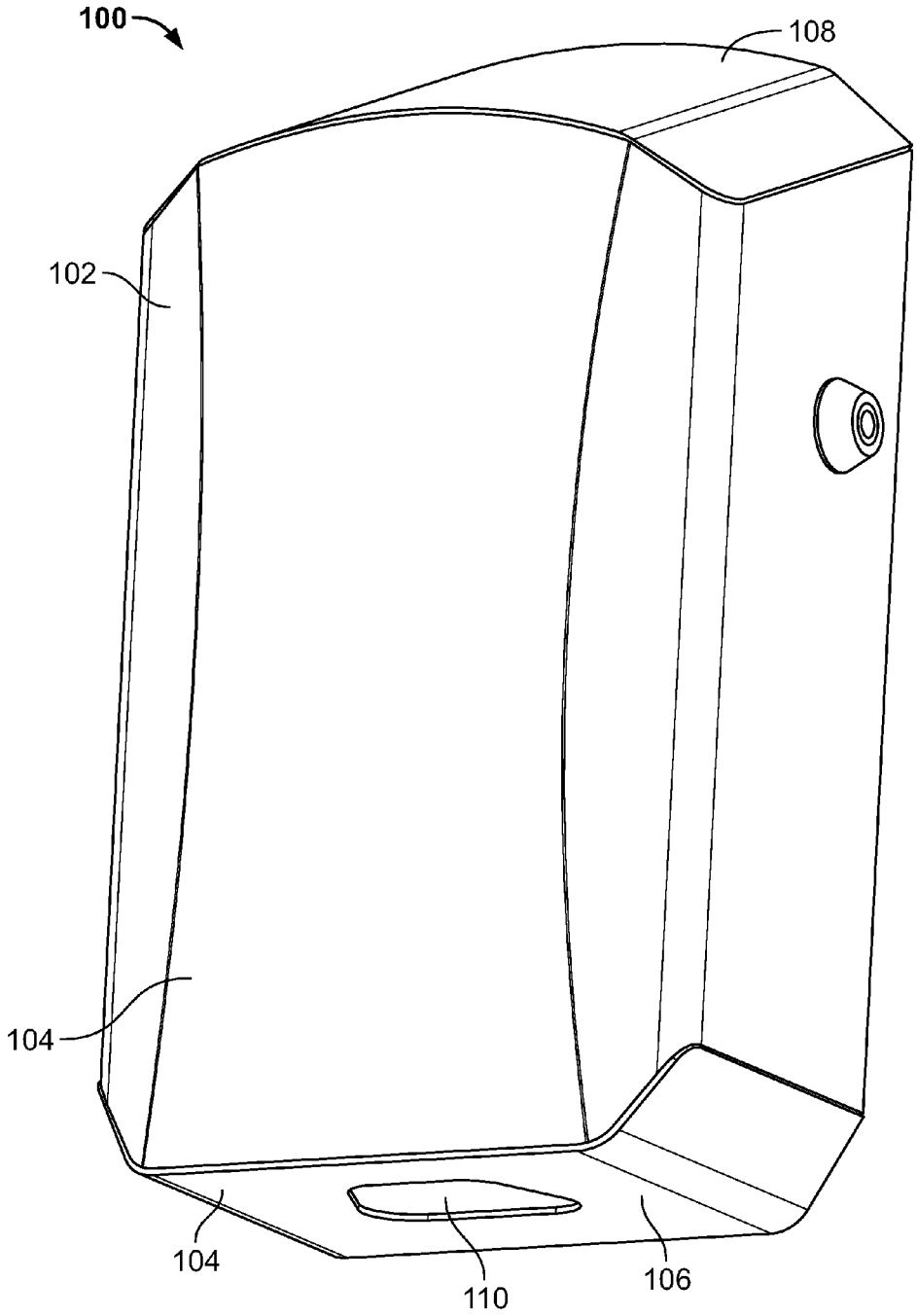
FIG. 1 is an illustration of an example product dispenser.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter. Relative size, orientation, etc. of parts, components, etc. may differ from that which is illustrated while not falling outside of the scope of the claimed subject matter.

Referring to FIG. 1, a product dispenser 100 is illustrated. In an example, the product dispenser 100 can be used for storing and/or dispensing a product. The product comprises any type of liquid, semi-liquid, gel, powder, foam based materials, etc. The product may comprise, for example, cleaning materials such as disinfectants, sanitizers, antiseptics, soaps, moisturizers, alcohol-infused liquids, or the like. In an example, the product comprises water or other non-cleaning liquid materials. Indeed, the product is not specifically limited to these examples, and could include other types of materials.

The product dispenser 100 can be attached, for example, to a surface, such as a surface of a wall, ceiling, door, object, support structure, etc. The product dispenser 100 can be used in any number of environments, including prisons/jails, detention centers, mental health facilities, hospitals, mental hospitals, rehabilitation facilities, nursing homes, restaurants, schools, factories, warehouses, etc.

The product dispenser 100 comprises an enclosure 102. In an example, the enclosure 102 comprises at least one wall 104 that can define an interior of the enclosure 102 within which portions of the product dispenser 100 can be contained. In an example, the enclosure 102 may be substantially hollow so as to receive one or more structures or components therein. In an example, the enclosure 102 comprises a rigid and/or durable structure and/or material that may be resistant to tampering and/or inadvertent access. For example, the enclosure 102 may comprise a metal material (e.g., steel, aluminum, titanium, etc.), though, in other examples, the enclosure 102 may comprise plastic materials, composite materials, etc. Indeed, the enclosure 102 comprises any number of materials that can limit inadvertent and/or unauthorized access to the interior of the enclosure 102.

The enclosure 102 can extend between a first end 106 and a second end 108. The first end 106 can define a bottom of the enclosure 102 that faces towards a floor. The second end 108 may be opposite the first end 106 and can define a top of the enclosure 102 that faces away from the floor (e.g., by facing towards a ceiling or roof). The wall 104 can define an aperture 110 at the first end 106 through which the product can be dispensed to a user. That is, in an example, the aperture 110 can be formed along a bottom of the enclosure 102 such that a user may place his or her hand below the product dispenser 100 to receive the product through the aperture 110.

Figure 2:
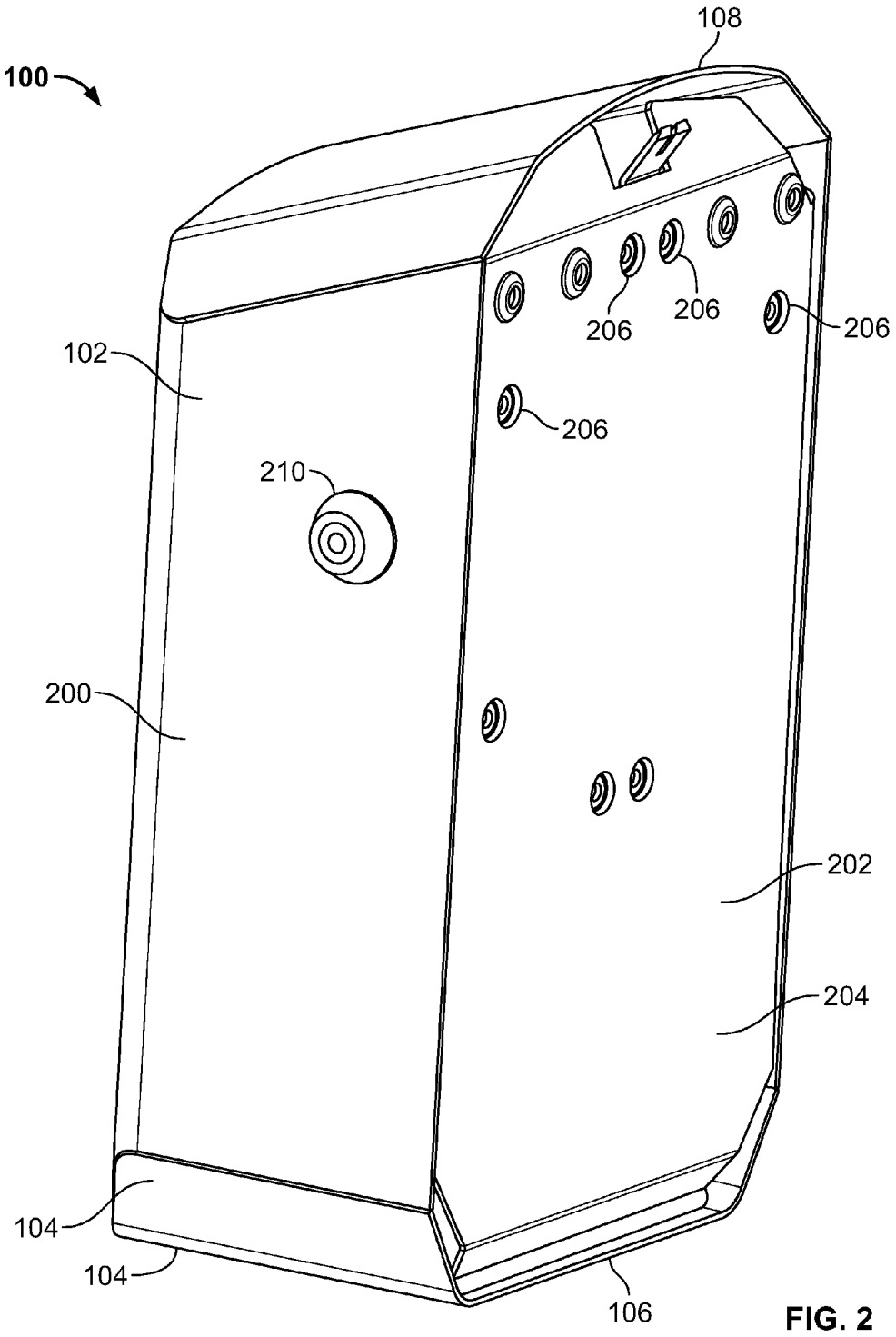
FIG. 2 is an illustration of a base portion and a cover portion of an example product dispenser.

Referring to FIG. 2, a rear perspective view of the product dispenser 100 is illustrated. In an example, the enclosure 102 comprises a cover portion 200 and a base portion 202. The cover portion 200 is configured to be attached to the base portion 202. The base portion 202 can be attached to a surface (e.g., wall, ceiling, door, object, support structure).

In an example, the base portion 202 comprises a back plate 204 defining one or more openings 206. In an example, the base portion 202 can receive one or more attachment structures (e.g., mechanical fasteners such as screws, bolts, etc.) through the openings 206 to attach the base portion 202 to the surface. In an example, the enclosure 102 comprises a lock 210 for holding the cover portion 200 in a fixed position relative to the base portion 202. That is, the lock 210 can maintain the cover portion 200 and the base portion 202 in a closed position (e.g., as illustrated in FIG. 2), wherein the interior of the enclosure 102 is inaccessible. The lock 210 can be moved to an unlocked positioned so as to allow the cover portion 200 to move to an opened position, thus allowing for access to the interior of the enclosure 102.

Figure 3:
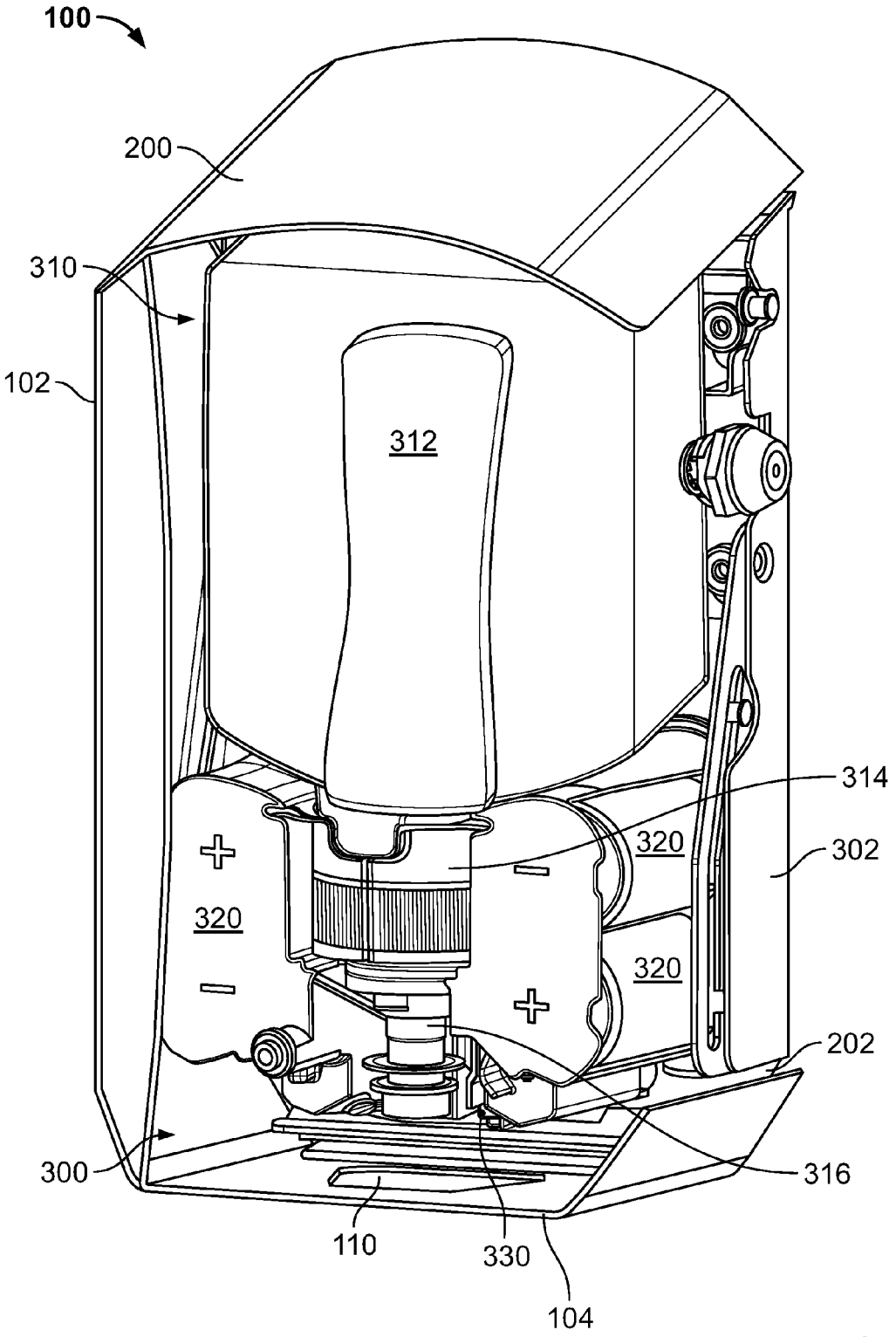
FIG. 3 is an illustration of an interior of an example product dispenser.

Referring to FIG. 3, the product dispenser 100 is illustrated with a portion of the cover portion 200 removed so as to illustrate an interior 300 of the product dispenser 100. In an example, the cover portion 200 and the base portion 202 define the interior 300 of the enclosure 102. In an example, at least one of the cover portion 200 or the base portion 202 can define the aperture 110. For example, the cover portion 200 can define the aperture 110 while the base portion 202 may not define an aperture. In an example, the base portion 202 can define the aperture 110 while the cover portion 200 may not define an aperture. In an example, both the cover portion 200 and the base portion 202 define the aperture 110, such as by cover portion 200 defining a first portion of the aperture 110 while the base portion 202 defines a second portion of the aperture 110.

In an example, the cover portion 200 may be pivotally attached to the base portion 202. The enclosure 102 may comprise a bracket 302 that rotatably connects at one end to the cover portion 200, and at another end to the base portion 202. The bracket 302 can allow for the cover portion 200 to move and/or pivot with respect to the base portion 202 between an opened position, in which the interior 300 of the enclosure 102 is accessible, and a closed position, in which the interior 300 of the enclosure 102 is non-accessible.

It will be appreciated that the illustrated examples of the cover portion 200 and the base portion 202 are not intended to be limiting. Rather, in an example, other embodiments are contemplated, such as an example in which the base portion 202 may have a concave shape while the cover portion 200 may be substantially planar. Likewise, in an example, the cover portion 200 and the base portion 202 may not be pivotally attached but, rather, the cover portion 200 may be movable relative to the base portion 202 between the opened position and the closed position.

The product dispenser 100 comprises a dispensing assembly 310 within which the product is contained and from which the product is dispensed. In an example, the dispensing assembly 310 may be supported within the interior 300 of the enclosure 102 such that the dispensing assembly 310 may dispense the product through the aperture 110. The dispensing assembly 310 can be attached to one or both of the cover portion 200 or the base portion 202 of the enclosure 102.

The dispensing assembly 310 comprises a reservoir 312 within which the product is contained and from which the product is dispensed. In an example, the reservoir 312 comprises one or more sidewalls that define an interior into which the product is stored. The reservoir 312 may comprise an outlet through which the product may be selectively dispensed. In an example, the reservoir 312 may be positioned towards an upper portion of the interior 300 of the enclosure 102, though other possible locations are envisioned.

The dispensing assembly 310 comprises a product pump 314 that is configured to dispense the product. In an example, the product pump 314 may be in fluid communication with the reservoir 312, so as to selectively cause the product to be dispensed from the reservoir 312. In an example, the product pump 314 may be located below the reservoir 312 between the aperture 110 and the reservoir 312. In this way, the product pump 314 can pump the product from the reservoir 312 with the benefit of gravity. In other examples, however, the product pump 314 may be located along a side of the reservoir 312, or at other locations within the interior 300.

The dispensing assembly 310 comprises a nozzle 316 that is in fluid communication with the product pump 314. In an example, the product that is dispensed by the product pump 314 may pass through the nozzle 316 and through the aperture 110. In an example, the nozzle 316 may be located below the product pump 314 between the aperture 110 and the product pump 314. The nozzle 316 may be aligned with the aperture 110, such that the product may flow through the nozzle 316 and through the aperture 110. In this way, the nozzle 316 can receive the product from the reservoir 312 and the product pump 314 with the benefit of gravity.

The dispensing assembly 310 comprises a power source 320. In an example, the power source 320 may be received onboard the product dispenser 100 and/or the reservoir 312. The power source 320 may comprise, for example, batteries, photovoltaic cells, or an outside source such as mains power from a facility in which the product dispenser 100 is installed. In these examples, power may be drawn from the power source 320 and selectively directed by a controller to the product pump 314 for dispensing the product.

A dispense event may be initiated in any number of ways for dispensing the product from the reservoir 312 and through the aperture 110 to a user. In an example, the dispensing assembly 310 comprises one or more sensors 330 that are in communication with the product pump 314. The sensors 330 can detect the presence of a user's hand positioned beneath the nozzle 316 (e.g., and aperture 110) and in turn send a signal to a controller 340 (e.g., illustrated in FIG. 14). The controller 340 can generate an output that is connected to the product pump 314 and/or the power source 320. This output can trigger a dispense event, whereupon the product pump 314 can dispense the product from the reservoir 312. In an example, the sensors 330 may comprise non-contact sensors that are mounted proximate to the nozzle 316.

It is to be appreciated that other methods for initiating a dispense event may be incorporated into the product dispenser 100. That is, the dispensing assembly 310 is not limited to comprising the sensors 330 for detecting the presence of the user's hand. Rather, in an example, the dispensing assembly 310 may be manually operated. In such an example, a push-bar may be pivotally connected to the enclosure 102. The push-bar may be selectively depressed by the user, such that movement of the push-bar may engage the product pump 314. In an example, the product pump 314 may comprise a dome pump, such that when engaged by the push-bar, the product pump 314 can dispense the product from the reservoir 312.

Figure 4:
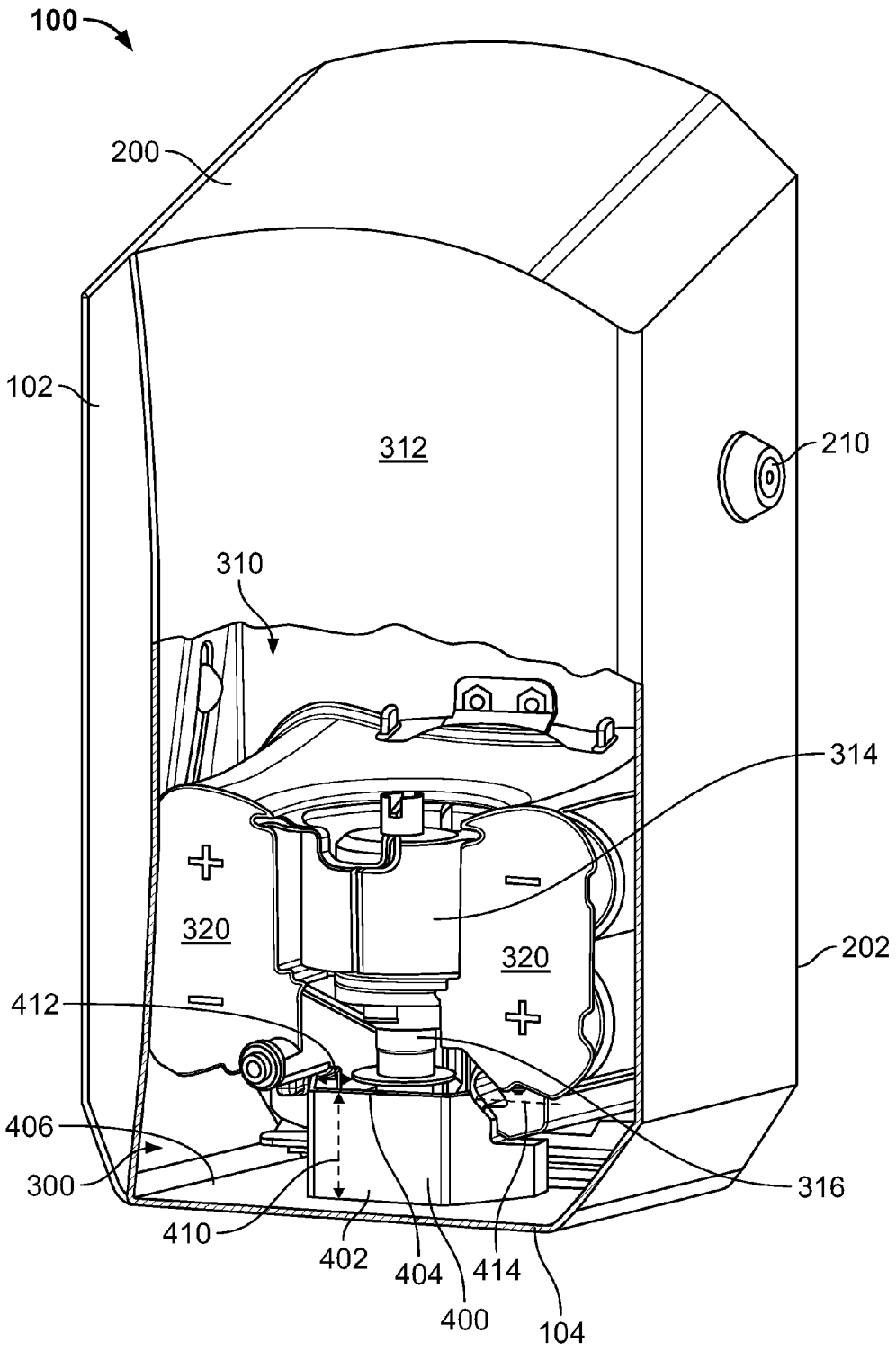
FIG. 4 is an illustration of a barrier guard for an example product dispenser.

Referring to FIG. 4, the product dispenser 100 comprises a barrier guard 400. The barrier guard 400 can extend around a perimeter of the aperture 110 between the wall 104 and the dispensing assembly 310. In this way, the barrier guard 400 can inhibit accessibility to the interior 300 of the enclosure 102 between the barrier guard 400 and the wall 104. The barrier guard 400 can extend substantially contiguously around the perimeter of the aperture 110 and, in an example, may be devoid of gaps, spaces, openings, formed through the barrier guard 400 about the perimeter of the aperture 110. By being devoid of gaps, spaces, openings, etc., the barrier guard 400 can limit users from gaining access to the interior 300 of the enclosure 102 through the barrier guard 400. In an example, the barrier guard 400 may comprise a similar or identical material to the enclosure 102, such as a metal material (e.g., steel, aluminum, titanium, etc.), plastic materials, composite materials, etc.

In an example, the barrier guard 400 can extend around a perimeter of the aperture 110 between the nozzle 316 of the dispensing assembly 310 and at least one of the cover portion 200 or the base portion 202. For example, when the cover portion 200 defines the aperture 110, the barrier guard 400 can extend between the nozzle 316 and the cover portion 200. When the base portion 202 defines the aperture 110, the barrier guard 400 can extend between the nozzle 316 and the base portion 202. When both the cover portion 200 and the base portion 202 define the aperture 110, the barrier guard 400 can extend between the nozzle 316 and both the cover portion 200 and the base portion 202.

The barrier guard 400 comprises a solid and/or rigid wall that extends between a first end 402 and a second end 404. The first end 402 may be attached to an interior surface 406 of the wall 104. In an example, the first end 402 of the barrier guard 400 may be integrally formed with the wall 104, such that the barrier guard 400 and the wall 104 may be a one piece formed structure. In an example, the second end 404 of the barrier guard 400 may be in proximity to the nozzle 316 of the dispensing assembly 310. While any number of angles may be defined between the barrier guard 400 and the wall 104, in an example, the barrier guard 400 may extend perpendicular relative to the wall 104 that defines the aperture 110.

In an example, the barrier guard 400 may have a guard length 410 between the first end 402 and the second end 404. The guard length 410 may be measured along an axis that is perpendicular to the wall 104. In an example, the second end 404 of the barrier guard 400 may be spaced a separating distance 412 from the dispensing assembly 310. For example, the second end 404 may be spaced the separating distance 412 from the nozzle 316 of the dispensing assembly 310. In an example, the separating distance 412 may be less than the guard length 410.

The second end 404 of the barrier guard 400 can define a plane 414. In an example, the plane 414 may be parallel to the wall 104 of the enclosure 102. In an example, a portion of the dispensing assembly 310 (e.g., the nozzle 316) can extend within an interior of the barrier guard 400 and may intersect the plane 414. In this way, portions of the dispensing assembly 310 (e.g., the product pump 314, the nozzle 316) may be in close proximity to the barrier guard 400 so as to define a relatively small separating distance 412. As such, items may be limited from being inserted into the interior 300 of the enclosure 102 by passing between the barrier guard 400 and the dispensing assembly 310.

Figure 5:
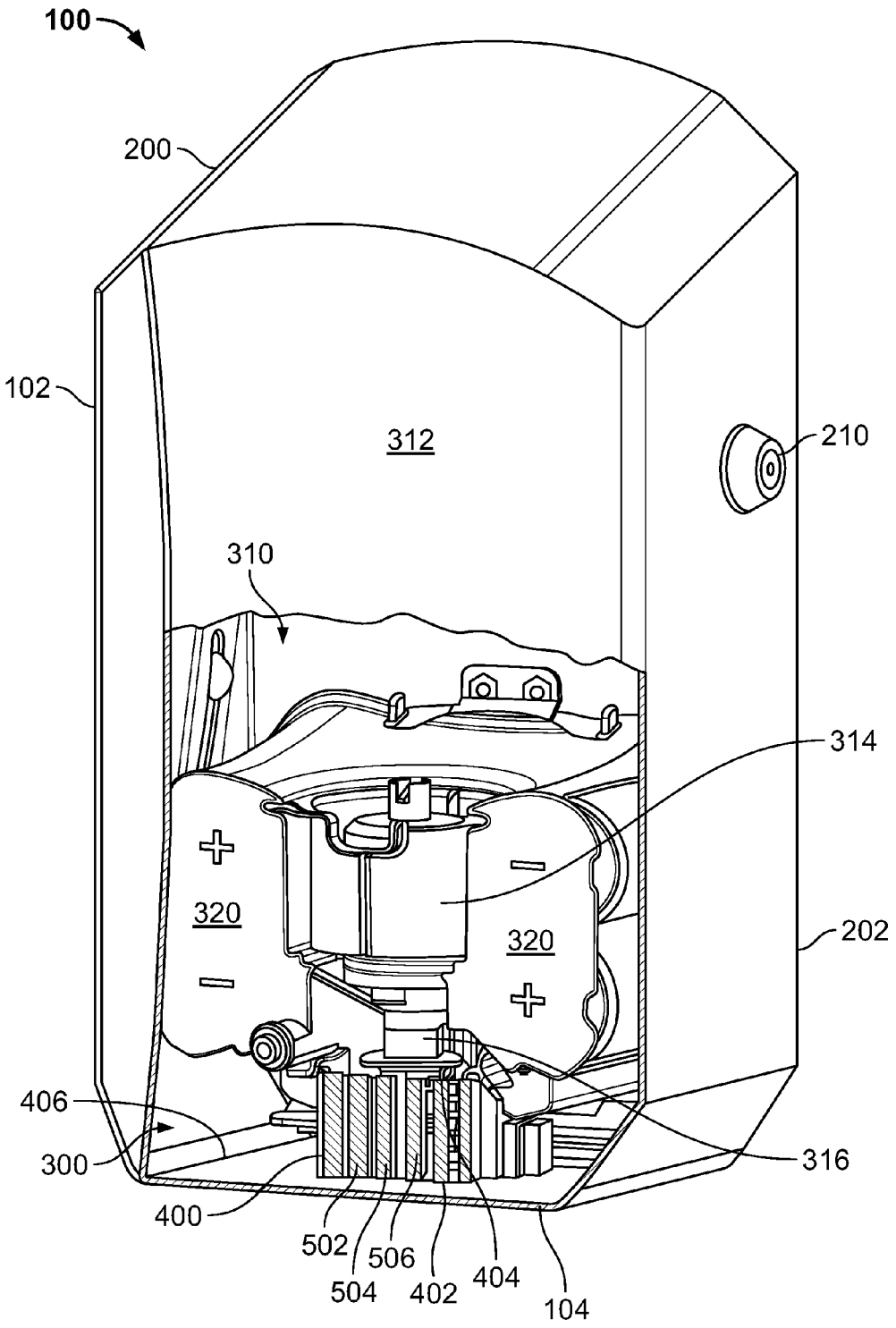
FIG. 5 is an illustration of a barrier guard for an example product dispenser.

Referring to FIG. 5, a second example of the barrier guard 400 is illustrated. In an example, the barrier guard 400 may not extend substantially contiguously around the perimeter of the aperture 110 so as to be devoid of gaps, spaces, openings. Rather, in an example, the barrier guard 400 may comprise one or more wall segments 500 that together form the barrier guard 400. In an example, the one or more wall segments 500 may comprise a first wall segment 504, a second wall segment 506, etc.

The one or more wall segments 500 can extend between the first end 402 and the second end 404, with the first end 402 attached to the interior surface 406 of the wall 104. In an example, the one or more wall segments 500 may be spaced apart from each other to define an opening between adjacent wall segments. For example, the first wall segment 504 may be spaced apart from the second wall segment 506 to define an opening. However, the opening between adjacent wall segments (e.g., the first wall segment 504 and the second wall segment 506) may be small enough so as to limit a user from inserting an item through the opening.

Figure 6:
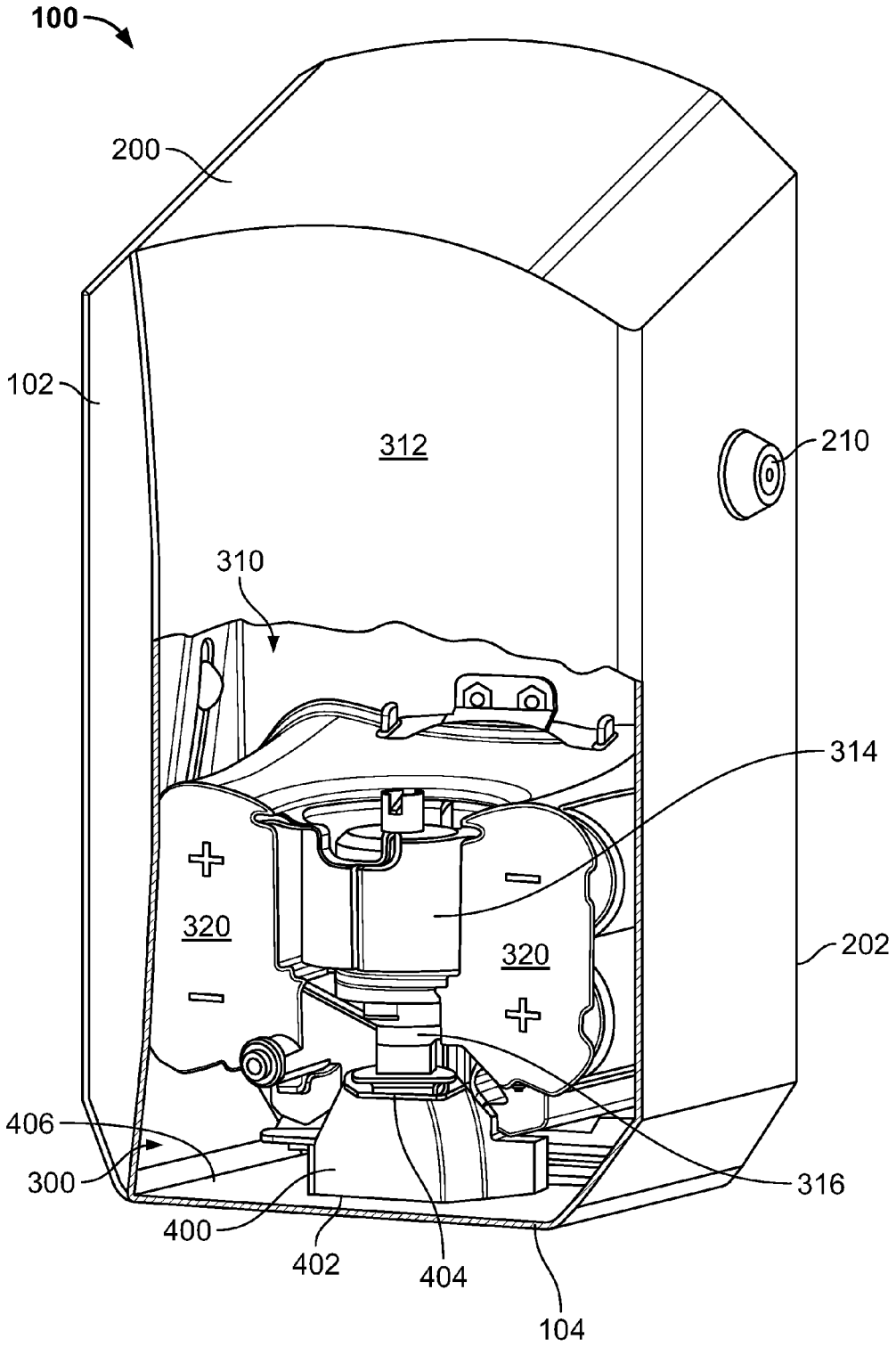
FIG. 6 is an illustration of a barrier guard for an example product dispenser.

Referring to FIG. 6, a third example of the barrier guard 400 is illustrated. In the examples of FIGS. 4 and 5, the barrier guard 400 extended substantially linearly along an axis between the first end 402 and the second end 404. However, in an example, the barrier guard 400 may not extend linearly, and, instead, the barrier guard 400 can extend non-linearly between the first end 402 and the second end 404.

For example, the barrier guard 400 can taper inwardly or outwardly between the first end 402 and the second end 404.

In an example, from the first end 402 to the second end 404, the barrier guard 400 can taper inwardly such that a cross-sectional size of an opening defined by the barrier guard 400 may decrease from the first end 402 towards the second end 404. In an example, the second end 404 of the barrier guard 400 can taper inwardly to match an outer diameter of the nozzle 316. In this way, the separating distance 412 between the second end 404 of the barrier guard 400 and the nozzle 316 may be reduced so as to limit a user from inserting an item through the opening between the barrier guard 400 and the dispensing assembly 310.

Figure 7:
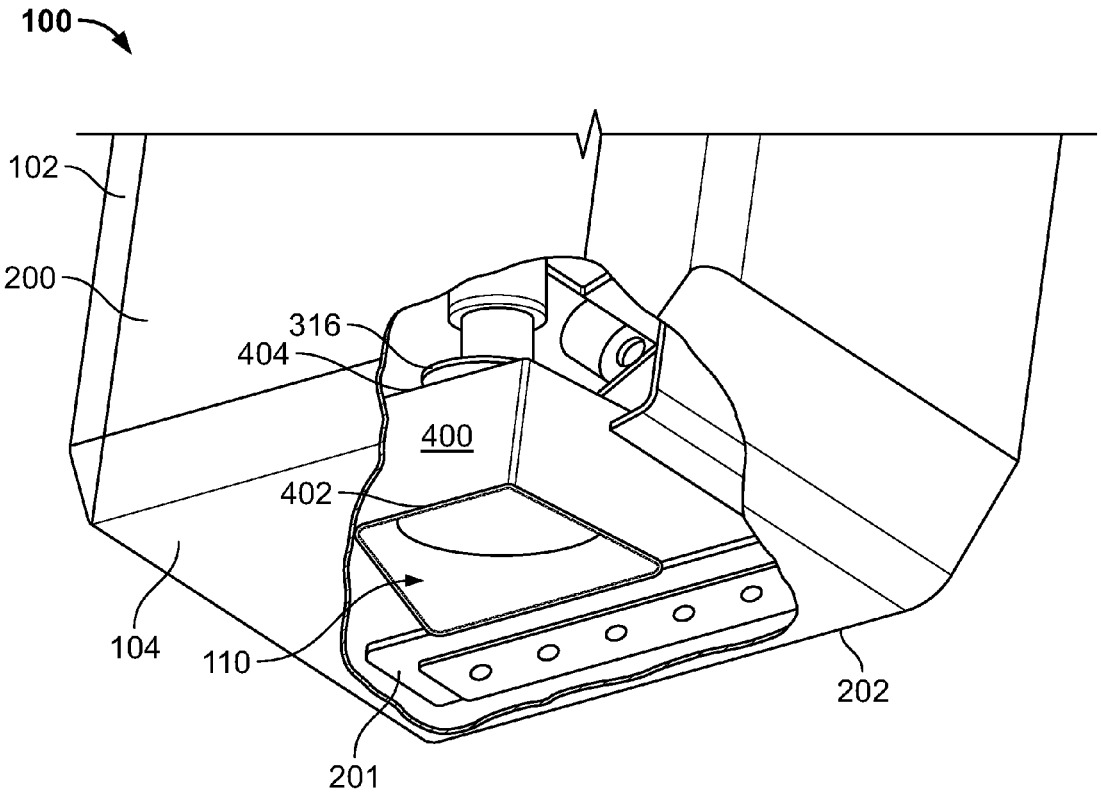
FIG. 7 is an illustration of a barrier guard for an example product dispenser.

Referring to FIG. 7, a fourth example of the barrier guard 400 is illustrated. In the examples of FIGS. 4 to 6, the barrier guard 400 may be integrally formed with the interior surface 406 of the wall 104. However, in an example, the barrier guard 400 and the wall 104 need not be a one-piece formed structure. Rather, in an example, the barrier guard 400 can be a separate structure from the enclosure 102 and may be attached to the enclosure 102.

In an example, the barrier guard 400 comprises a flange 201. The flange 201 may be attached to (e.g., one of the walls, an outer surface, etc.) of the barrier guard 400 (e.g., screws, weld, adhesive, etc.). In an example, the flange 201 may be attached to the first end 402 of the barrier guard 400. In an example, some or all of the flange may be an integral part of the barrier guard (e.g., the barrier guard may be fabricated to comprise some or all of the flange). The flange may be a single piece (e.g., lip, protrusion, etc.) that encircles some or all of the barrier guard. The flange may comprise multiple pieces that encircle some of all of the barrier guard. The flange 201 may define one or more openings through which a fastener is configured to be received.

To attach the barrier guard 400 to the enclosure 102, the flange 201 may be positioned adjacent to and/or in contact with the wall 104 of the enclosure 102. A locking structure can be used to attach the flange 201 to the wall 104. In an example, the locking structure comprises mechanical fasteners (e.g., screws, bolts, etc.) that can be passed through the openings in the flange 201 and through the wall 104. In this way, the flange 201 can be attached to the wall 104 by the mechanical fasteners. The locking structure is not limited to mechanical fasteners, however, and in an example, the flange 201 may be attached to the wall 104 by welding, adhesives, snap fit, etc.

Figure 8:
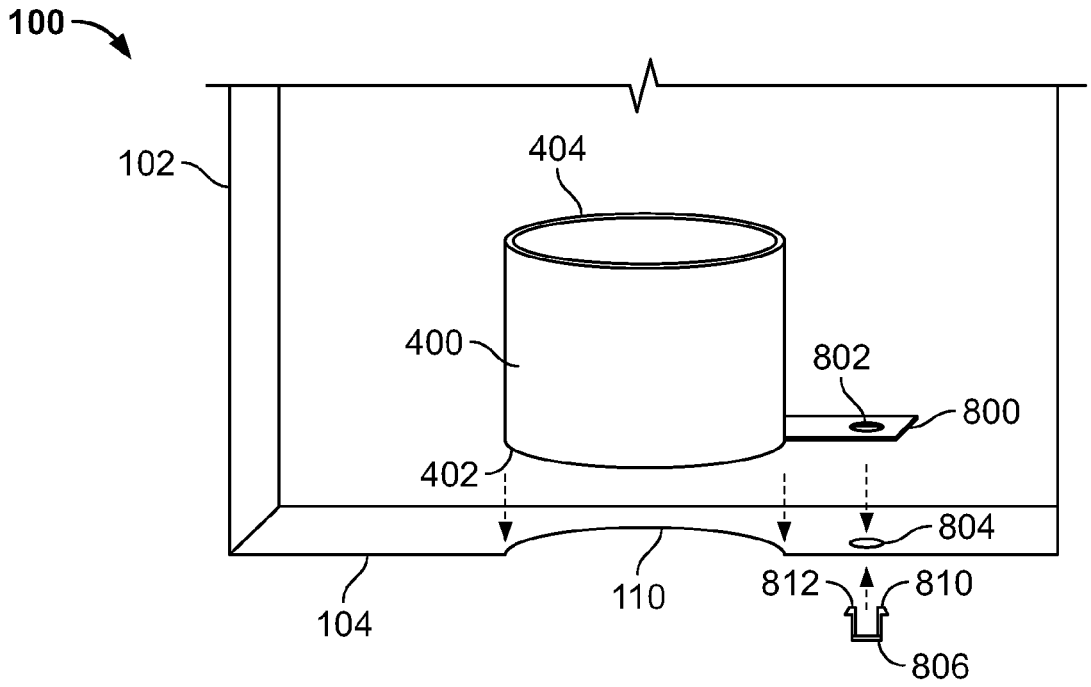
FIG. 8 is an illustration of a barrier guard for an example product dispenser.
Figure 9:
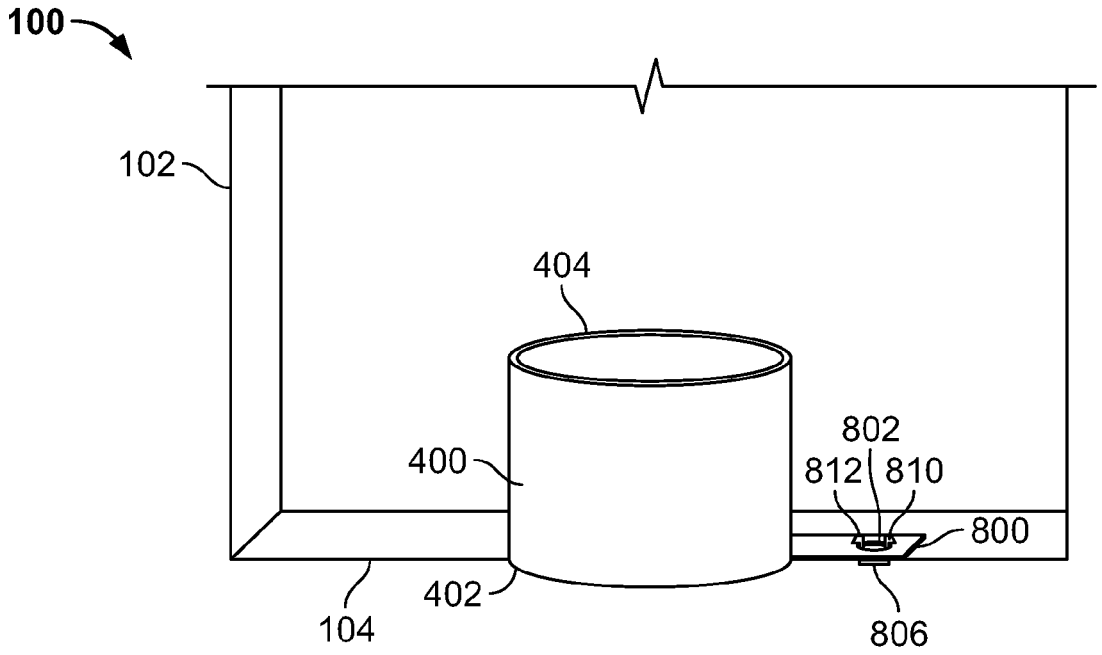
FIG. 9 is an illustration of a barrier guard for an example product dispenser.

FIGS. 8 and 9 further illustrate the barrier guard 400 being separately attachable. In an example, the flange 201 can extend substantially parallel to the wall 104 that defines the aperture 110. In an example, the wall 104 can define a wall opening 804 adjacent to the aperture 110. In an example, the flange opening 802 can be aligned with the wall opening 804 so as to receive a mechanical fastener. In this way, the mechanical fastener (e.g., and/or a non-mechanical fastener) can attach the barrier guard 400 to the wall 104. In an example, the wall opening 804 (e.g., and/or any other aspect that allows the barrier guard 400 to be attached to the product dispenser 100) may comprise preexisting geometry of the product dispenser 100 such that the barrier guard may be attached to the product dispenser 100 with few to no alterations to the product dispenser 100.

FIGS. 8 and 9 illustrate an example fastener 806. The fastener 806 is sized to be at least partially received within the flange opening 802 and the wall opening 804. In an example, the fastener 806 comprises one or more fastener legs, such as a first fastener leg 810 and a second fastener leg 812. The first fastener leg 810 and the second fastener leg 812 can be compressed towards each other so as to reduce a width of the fastener 806. In an example, the first fastener leg 810 and the second fastener leg 812 may be flexibly attached such that, in response to an outward pressure applied to the first fastener leg 810 and/or the second fastener leg 812, the first fastener leg 810 and the second fastener leg 812 can move towards each other.

In operation, the barrier guard 400 can be positioned adjacent to and surrounding the aperture 110. The flange 201 can extend parallel to and in contact with the wall 104 of the enclosure 102. The flange opening 802 can be aligned with the wall opening 804 so as to receive the fastener 806. The fastener 806 can be compressed, such as by moving the first fastener leg 810 and the second fastener leg 812 towards each other. In this way, the first fastener leg 810 and the second fastener leg 812 can be inserted through the wall opening 804 and the flange opening 802. The first fastener leg 810 and the second fastener leg 812 may comprise gripping portions (e.g., ledges, protrusions, teeth, etc.) that can engage the flange 201 and limit the fastener 806 from being inadvertently removed from the flange opening 802 and the wall opening 804. In this way, the barrier guard 400 can be attached to the wall 104 of the enclosure 102, with the barrier guard 400 surrounding the aperture 110. It will be appreciated, however, that the flange and/or the manner of attaching the flange to the product dispenser 100 is not so limited (e.g., and that this is true not only here but extends to all other embodiments as well). For example, the flange may be a single piece (e.g., lip, protrusion, etc.) that encircles some or all of the barrier guard with one or more features (e.g., opening(s), protrusions(s), etc.) that allow the flange to the attached to the product dispenser 100. The flange may comprise multiple pieces (e.g., lip, protrusion, etc.) that encircles some or all of the barrier guard with one or more features (e.g., opening(s), protrusion(s), etc.) that allow the flange to the attached to the product dispenser 100. The barrier guard may comprise some or all of the flange (e.g., the barrier guard may be fabricated so that some or all of flange is part of the barrier guard).

Figure 10:
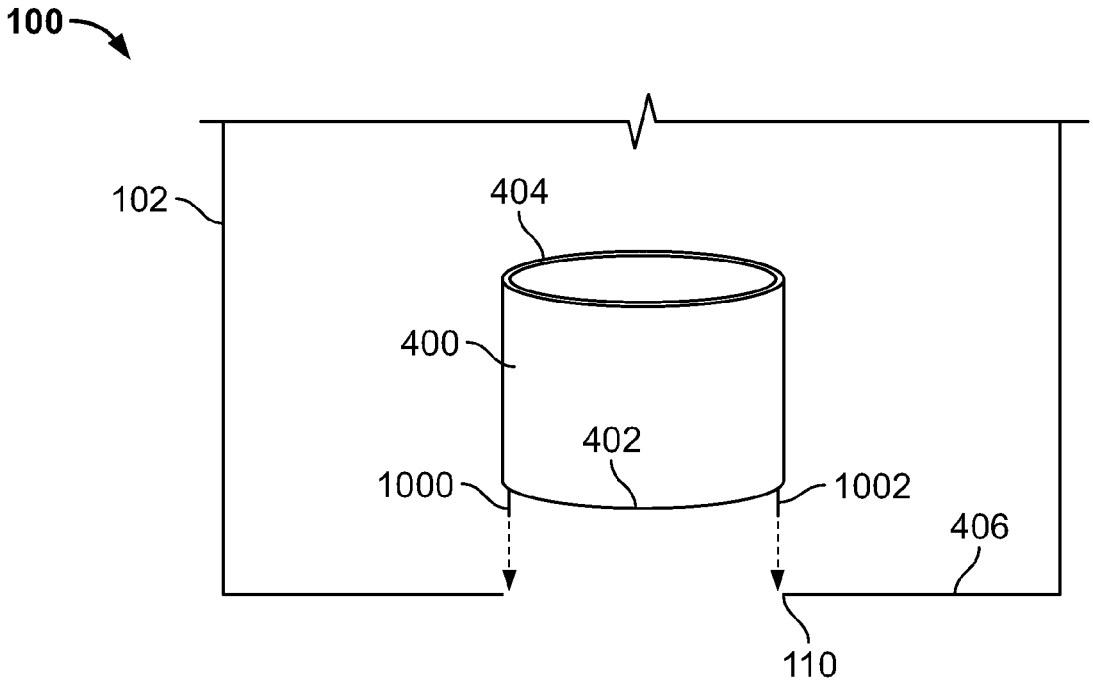
FIG. 10 is an illustration of a barrier guard for an example product dispenser.

Referring to FIG. 10, an example of the barrier guard 400 is illustrated. In an example, the barrier guard 400 comprises one or more flanges, protrusions, etc. that can attach the barrier guard 400 to the wall 104 of the enclosure 102. For example, the barrier guard 400 may comprise a first flange 1000 and a second flange 1002. The first flange 1000 and the second flange 1002 can be attached to the first end 402 of the barrier guard, with the first flange 1000 and the second flange 1002 initially projecting in a direction that is substantially perpendicular to the wall 104.

Figure 11:
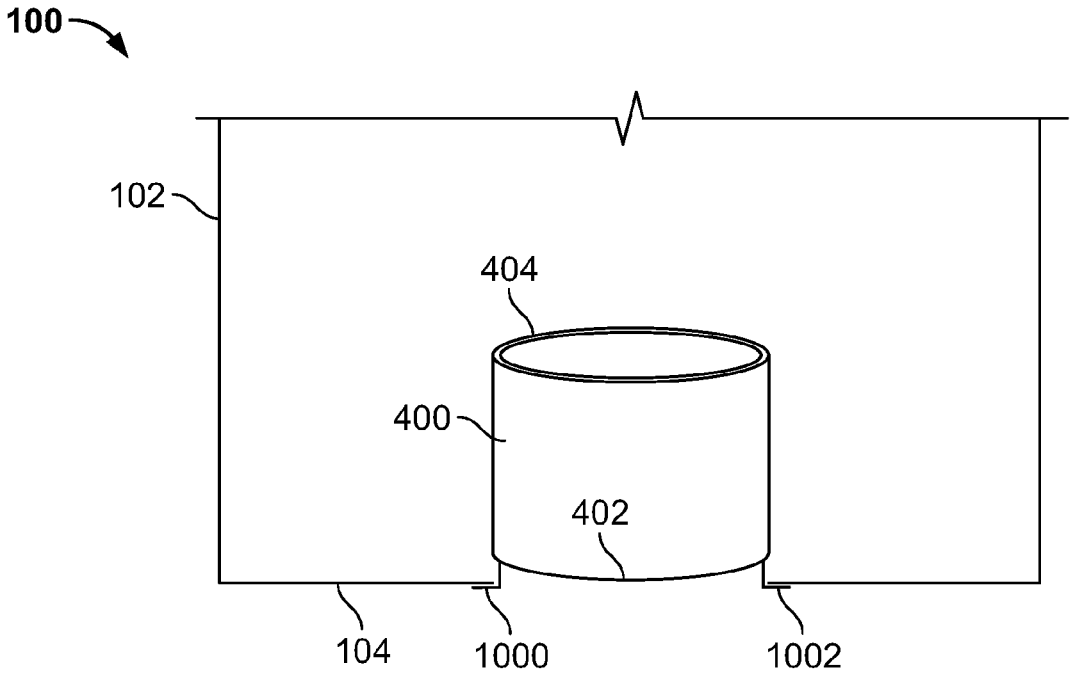
FIG. 11 is an illustration of a barrier guard for an example product dispenser.

Referring to FIG. 11, the barrier guard 400 can be positioned to extend around the aperture 110 (e.g., illustrated in FIG. 10). For example, the barrier guard 400 can be moved downwardly towards the aperture 110. The first flange 1000 and the second flange 1002 can extend through the aperture 110, with the first end 402 of the barrier guard 400 abutting and contacting the interior surface 406 of the wall 104 defining the aperture 110. Once the first flange 1000 and the second flange 1002 have passed through the aperture 110, the first flange 1000 and the second flange 1002 can be bent outwardly (e.g., radially outwardly from a center of the barrier guard) so as to engage an exterior surface of the wall 104 of the enclosure 102. In this way, the first flange 1000 and the second flange 1002 maintain the barrier guard 400 in place relative to the aperture 110. Such attachment mechanisms (e.g., flanges, protrusions, etc.) can then be further attached (e.g., welded, melted, etc.) to the exterior surface of the wall 104 to inhibit displacement of the same (e.g., discouraging vandalism).

Figure 12:
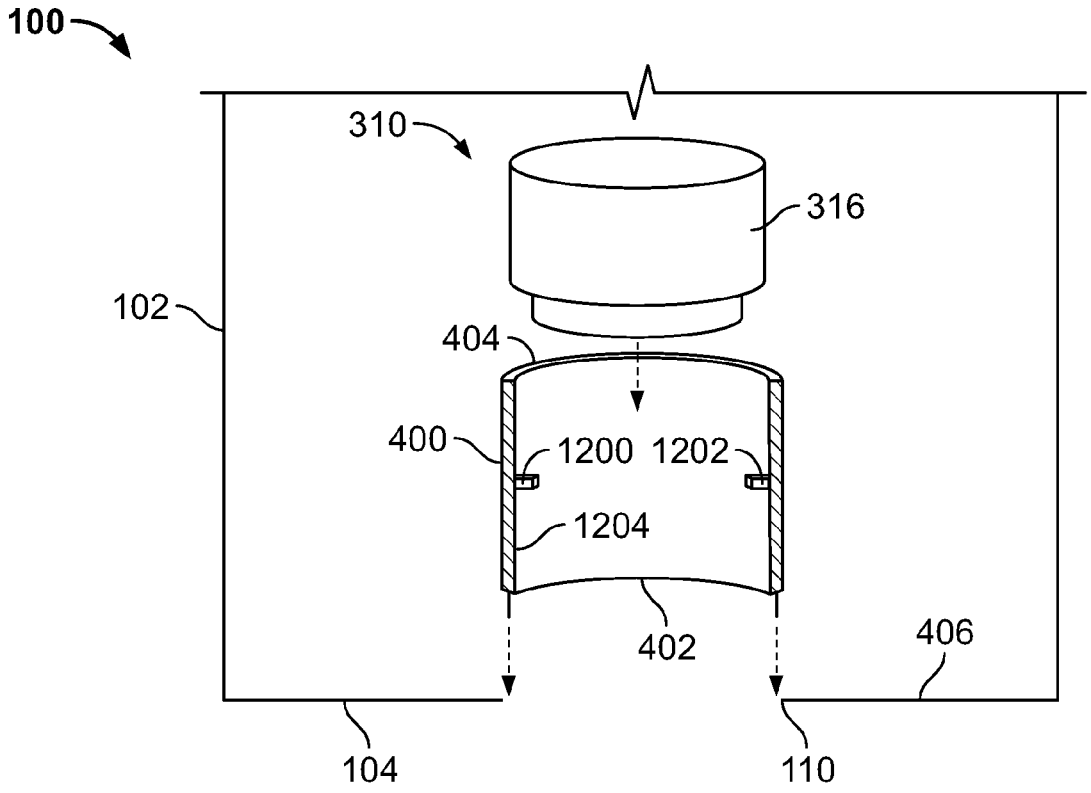
FIG. 12 is an illustration of a barrier guard for an example product dispenser.
Figure 13:
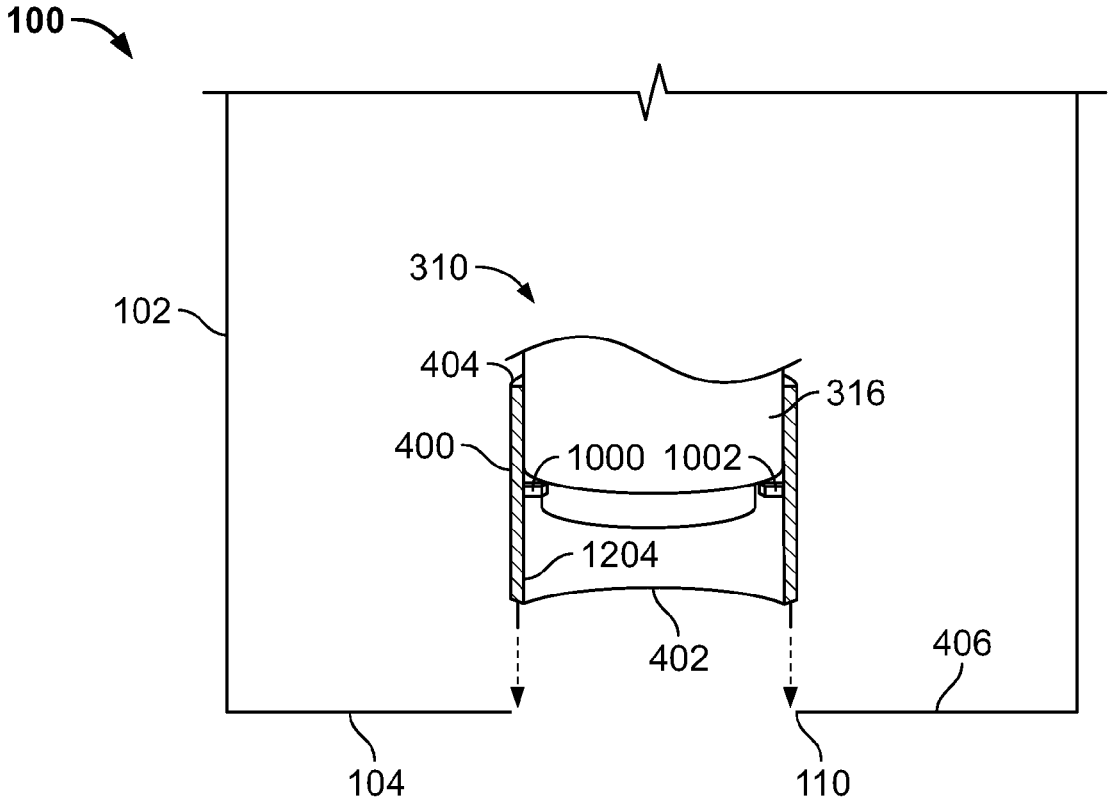
FIG. 13 is an illustration of a barrier guard for an example product dispenser.

Referring to FIGS. 12 and 13, an example of the barrier guard 400 is illustrated. In an example, the barrier guard 400 comprises one or more flanges that may be formed on an interior surface 1204 of the barrier guard 400. For example, the barrier guard 400 may comprise a first flange 1200 and a second flange 1202 formed on the interior surface 1204. The first flange 1200 and the second flange 1202 can define a reduced cross-sectional size as compared to portions of the interior surface 1204 that don't comprise flanges. In an example, the first flange 1200 and the second flange 1202 are positioned at opposite circumferential locations of the barrier guard 400. However, in other examples, other possible locations of the flanges (e.g., the first flange 1200, the second flange 1202, etc.) are envisioned. For example, while the first flange 1200 and the second flange 1202 extend only partially about the interior surface 1204 of the barrier guard 400, in an example, the barrier guard 400 may comprise one or more flanges that extend completely around the interior surface 1204 and/or some flanges that extend completely around the interior surface 1204 as well as some flanges that only extend partially around the interior surface 1204.

Referring to FIG. 13, in an example, a portion of the dispensing assembly 310 can be received within an interior of the barrier guard 400. For example, the nozzle 316 of the dispensing assembly 310 can be received within the barrier guard 400. The first flange 1200 and the second flange 1202 (e.g., and/or other flange(s)) can be sized to engage and/or retain the nozzle 316. In an example, the first flange 1200 and the second flange 1202 engage the nozzle 316 to form a press-fit, or other type of attachment that limits the barrier guard 400 from being inadvertently removed from the nozzle 316. In this way, the barrier guard 400 may be attached to the nozzle 316. The dispensing assembly, with the barrier guard 400 attached thereto, can then be placed into the enclosure 102 such that the barrier guard 400 is seated around the aperture 110 as desired. In an example, the barrier guard may be further attached to the wall 104, such as described above.

Figure 14:
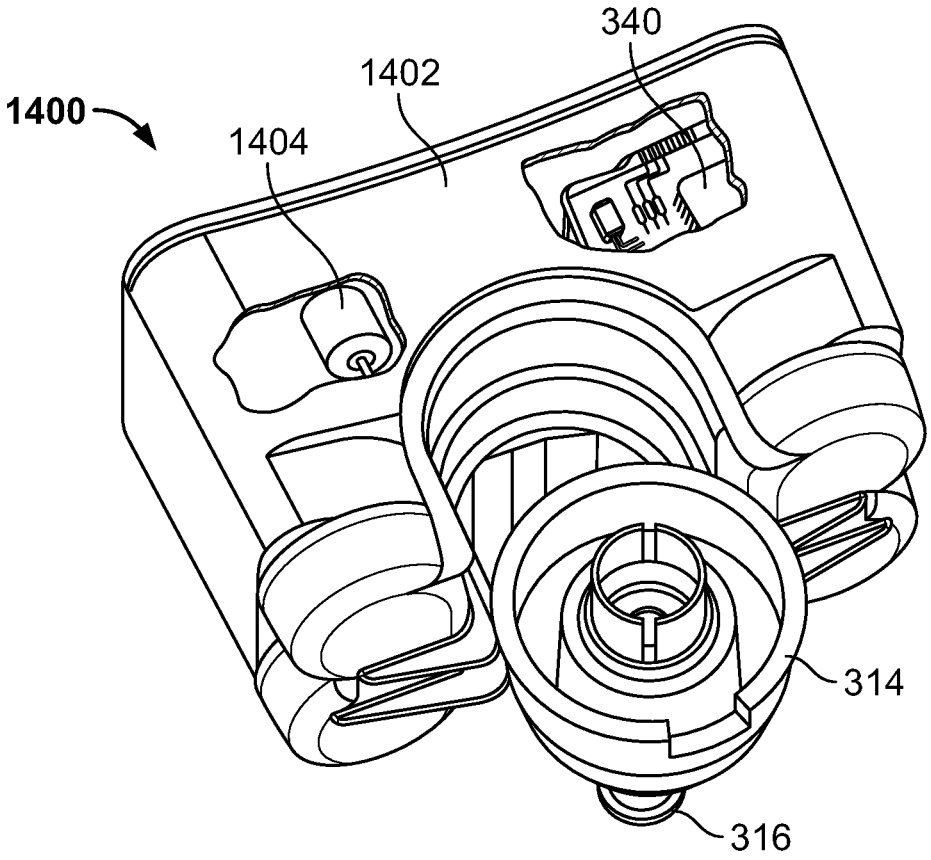
FIG. 14 is an illustration of an actuator for an example product dispenser.

Referring to FIG. 14, an example of an actuator 1400 for use with the dispensing assembly 310 is illustrated. In an example, the actuator 1400 comprises the product pump 314 and the nozzle 316. The actuator 1400 comprises an actuator housing 1402 that houses one or more structures related to pumping the product from the reservoir 312 through the nozzle 316. For example, the actuator 1400 comprises a motor 1404 that is housed within the actuator housing 1402. The motor 1404 may comprise an electric motor, a DC electric motor, etc. Though not illustrated, the motor 1404 may comprise gears, linkages, brackets, etc. that can be used to operate and/or engage the product pump 314.

The actuator 1400 comprises the controller 340. The controller 340 may have at least one input and one output, so as to selectively actuate the actuator 1400. The at least one input of the controller 340 can be operatively coupled to the sensors 330 so as to receive a signal from the sensors 330 when the user's hand is detected by the sensors 330.

In operation, the product dispenser 100 provides a number of benefits. For example, the barrier guard 400 can limit the likelihood of improper use of the product dispenser 100 occurring. The barrier guard 400 can engage the wall 104 of the enclosure 102 to extending around the perimeter of the aperture 110. In an example, the first end 402 of the barrier guard 400 can be formed with the wall 104, attached to the wall 104, in close proximity to the wall, etc. The second end 404 of the barrier guard 400 can engage the dispensing assembly 310. For example, the second end 404 of the barrier guard 400 can be formed with the dispensing assembly 310, attached to the dispensing assembly 310 (e.g., by being attached to the nozzle 316), in close proximity to the dispensing assembly 310 (e.g., by being in close proximity to the nozzle 316 as illustrated in FIG. 4), etc.

In this way, the barrier guard 400 can limit a user from inserting an item into the interior 300 of the enclosure 102. For example, the barrier guard 400 can inhibit accessibility to the interior 300 of the enclosure 102 between the barrier guard 400 and the wall 104, and between the barrier guard 400 and the dispensing assembly 310. As such, a user is limited and/or inhibited by the barrier guard 400 from inserting illicit or unwanted items into the interior 300.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first component and a second component generally correspond to component A and component B or two different or two identical components or the same component.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A product dispenser comprising:

an enclosure having at least one wall that defines an interior of the enclosure, the wall defining an aperture;

a dispensing assembly within which a product is contained and from which the product is dispensed, the dispensing assembly supported within the interior of the enclosure such that the dispensing assembly is configured to dispense the product through the aperture, the dispensing assembly having a nozzle through which the product is dispensed from the dispensing assembly; and a barrier guard extending around a perimeter of the aperture between the wall and the dispensing assembly to inhibit accessibility to the interior of the enclosure between the barrier guard and the wall, wherein:

the barrier guard extends between a first end and a second end, the first end of the barrier guard is attached to an interior surface of the wall, and the second end of the barrier guard lies within a plane and is spaced a separating distance from the nozzle, the separating distance measured in a direction parallel to the plane.

2. The product dispenser of claim 1, the enclosure comprising:

a base portion configured to be attached to a surface; and a cover portion attached to the base portion, the cover portion and the base portion defining the interior of the enclosure, at least one of the cover portion or the base portion defining the aperture.

3. The product dispenser of claim 1, the barrier guard having a guard length measured between the first end and the second end.

4. The product dispenser of claim 3, wherein the separating distance is less than the guard length.

5. The product dispenser of claim 1, a portion of the dispensing assembly extending within the barrier guard and intersecting the plane.

6. The product dispenser of claim 1, the barrier guard extending between the first end and the second end in a direction perpendicular relative to the wall that defines the aperture.

7. The product dispenser of claim 1, wherein the plane is perpendicular to the direction along which the product is dispensed from the dispensing assembly.

8. A product dispenser comprising:

an enclosure comprising:

a base portion configured to be attached to a surface; and a cover portion attached to the base portion, the cover portion and the base portion defining an interior of the enclosure, at least one of the cover portion or the base portion defining an aperture;

a dispensing assembly within which a product is contained and from which the product is dispensed, the dispensing assembly supported within the interior of the enclosure, the dispensing assembly comprising:

a product pump configured to dispense the product; and a nozzle in fluid communication with the product pump, the product dispensed by the product pump through the nozzle and through the aperture; and a barrier guard attached to an interior surface of at least one of the cover portion or the base portion that defines the aperture and extending contiguously around a perimeter of the aperture between the nozzle of the dispensing assembly and at least one of the cover portion or the base portion to inhibit accessibility to the interior of the enclosure between the barrier guard and the enclosure.

9. The product dispenser of claim 8, wherein the cover portion is pivotally attached to the base portion, the enclosure comprising a lock for holding the cover portion in a fixed position relative to the base portion.

10. The product dispenser of claim 8, wherein the barrier guard extends between a first end and a second end.

11. The product dispenser of claim 10, wherein the second end of the barrier guard is in proximity to the nozzle.

12. The product dispenser of claim 11, wherein the second end of the barrier guard spaced a separating distance from the nozzle, the separating distance less than a guard length measured between the first end and the second end.

13. The product dispenser of claim 10, wherein the second end of the barrier guard defines a plane, a portion of the dispensing assembly extending within the barrier guard and intersecting the plane.

14. The product dispenser of claim 8, wherein the barrier guard is separately attachable to the enclosure with a fastener.

15. A product dispenser comprising:

an enclosure having at least one wall that defines an interior of the enclosure, the wall defining an aperture;

a dispensing assembly within which a product is contained and from which the product is dispensed, the dispensing assembly supported within the interior of the enclosure such that the dispensing assembly is configured to dispense the product through the aperture; and a barrier guard extending between a first end and a second end, the first end of the barrier guard attached to an interior surface of the wall that defines the aperture and extending contiguously around a perimeter of the aperture, the second end of the barrier guard in proximity to the dispensing assembly to inhibit accessibility to the interior of the enclosure between the barrier guard and the wall.

16. The product dispenser of claim 15, the barrier guard integrally formed with the wall.

17. The product dispenser of claim 15, the second end of the barrier guard defining a plane, a portion of the dispensing assembly extending within the barrier guard and intersecting the plane.

18. The product dispenser of claim 15, the enclosure comprising:

a base portion configured to be attached to a surface; and a cover portion attached to the base portion, the cover portion and the base portion defining the interior of the enclosure, at least one of the cover portion or the base portion defining the aperture.

19. The product dispenser of claim 18, the cover portion movable relative to the base portion between an opened position, in which the interior of the enclosure is accessible, and a closed position.

20. The product dispenser of claim 15, the barrier guard extending between the first end and the second end in a direction perpendicular to the wall defining the aperture.

* * * * *